US005227751A

United States Patent [19]

Shiroyama et al.

[11] Patent Number: 5,227,751

[45] Date of Patent: Jul. 13, 1993

[54] ELECTROMAGNETIC SWITCH APPARATUS AND STARTER

[75] Inventors: Shigeru Shiroyama; Shuzou Isozumi, both of Himeji, Japan

[73] Assignee: Mitsubishi Denki Kabushiki Kaisha, Tokyo, Japan

[21] Appl. No.: 692,248

[22] Filed: Apr. 26, 1991

[30] Foreign Application Priority Data

Apr. 27, 1990 [JP] Japan ..... 2-112256
May 15, 1990 [JP] Japan ..... 2-125808
May 15, 1990 [JP] Japan ..... 2-125810

[51] Int. Cl.[5] ..... H01H 67/02
[52] U.S. Cl. ..... 335/126; 335/131
[58] Field of Search ..... 335/126, 131

[56] References Cited

U.S. PATENT DOCUMENTS 4,990,874 2/1991 Shiroyama ..... 335/126

FOREIGN PATENT DOCUMENTS 1004704 3/1957 Fed. Rep. of Germany .

*Primary Examiner*—Lincoln Donovan
*Attorney, Agent, or Firm*—Rothwell, Figg, Ernst & Kurz

[57] ABSTRACT

An electromagnetic switch apparatus incorporating a pair of stationary contacts and a movable contact at the rear end of a magnetic path core, wherein the stationary contacts are respectively composed of a contact part and a conductive part aligned in L-shape, wherein the conductive part at axial-directional side extends to the external circumference of an exciting coil, and wherein a terminal member is connected to an end of this conductive part and extends in the radial direction. A pair of stationary contacts are respectively molded in a pair of insulating members or in an insulating member secured to the rear end of the magnetic path core. An O-ring is secured to the external circumference of the insulating member. A case enveloping the exciting coil and a cover member enveloping those stationary and movable contacts respectively sandwich the O-ring in the axial direction to generate water-proof sealing effect. The intermediate region of a hollow rod which is secured to a movable core and has the front end extended to hollow region of an armature rotating shaft is held inside the internal circumferential region of a stationary core accross minimal gap which narrowly allows the hollow rod to slidably move in the axial direction therein.

6 Claims, 11 Drawing Sheets

ELECTROMAGNETIC SWITCH APPARATUS AND STARTER

BACKGROUND OF THE INVENTION

1. Field of the Invention

The present invention relates to an electromagnetic switch apparatus available for a starter needed for driving an engine and also to a coaxial type starter which coaxially aligns an electromagnetic switch apparatus and a DC motor.

2. Description of Related Art

FIG. 1 illustrates a sectional view of main components of a conventional coaxial-type starter denoting the first conventional art disclosed in the Japanese Patent Application Laid-Open No. 1-238445 of 1989 for example. Referring to the following description, a DC motor shown to the right of FIG. 1 is positioned in the front, whereas an electromagnetic switch apparatus shown to the left of FIG. 1 is positioned in the rear, respectively.

The reference numeral 1 shown in FIG. 1 designates a DC motor incorporating the following: a relay iron member 2, a field pole 3 (a permanent magnet) which is secured to the relay iron member 2, a rear bracket 4, a brush holder 5 which is secured to the rear bracket 4, and an armature 6 which consists of the following; a hollow armature rotating shaft 7, an armature core 8 which is secured to the hollow armature rotating shaft 7, an armature coil 9 which is secured to the armature core 8, and a commutator 10 which is secured to the hollow armature rotating shaft 7 and connected to the armature coil 9. The rear end of the hollow armature rotating shaft 7 is held by the rear bracket 4 through a bearing unit 11; whereas the front end of this shaft 7 is held by a bearing holder integrated with the front end itself through a bearing unit (not shown). A front bracket 13 is coupled with the relay iron member 2. The front bracket 13 incorporates an epicyclic reduction gear which is engaged with a pinion (a sun gear) provided on the external circumference of the front end of the hollow armature rotating shaft 7. The front bracket 13 also incorporates an overrunning clutch which is engaged with the output part of the epicyclic reduction gear. The rear end of an output rotary shaft 15 is held by the hollow armature rotating shaft 7 through a sleeve bearing unit 16. The intermediate region of the hollow armature rotating shaft 7 is engaged with the overrunning clutch by a helical spline. The hollow armature rotating shaft 7 transmits rotating force to the output rotary shaft 15 in order to rotate a pinion 17 which is coupled with the front end of the output rotary shaft 15 by a spline. The pinion 17 starts to move forward by the forward movement of the output rotary shaft 15, and then the pinion 17 is engaged with a ring gear of the engine so that the engine can start up its operation.

The reference numeral 20 shown in FIG. 1 designates an electromagnetic switch apparatus which is coaxially coupled with the rear end of the DC motor 1. The electromagnetic switch apparatus 20 has the structure shown below. An exciting coil 21 is wound on a bobbin 22. A stationary core 23 is disposed in front of the exciting coil 21. A guide bush member 24 which is made from non-magnetic material and secured to the stationary core 23 is inserted in the internal circumference of the bobbin 22. A magnetic path case 25 made from magnetic material is coupled with the rear bracket 4 with surrounding the external periphery of the exciting coil 21. The magnetic path case 25 makes up a magnetic path core and secures the stationary iron core 23 thereto. A movable core 26 is held inside of the guide bush member 24 with facing to the stationary core 23 so that it can slidably move itself in the axial direction. The movable iron core 26 makes up a plunger and returns to the original position by effect of a compression spring 38. The rear end of a push rod 27 held by pressure of a coil spring 28 is placed inside of the movable core 26, whereas the front end of the push rod 27 presses the rear end of the output rotary shaft 15 through a steel ball 29.

A pair of stationary contacts 30 are secured by means of an insulating member 31 made from plastic material. A pair of terminal bolts 30*a* and 30*b* externally project themselves from those stationary contacts 30. A lead wire from a DC power-supply source (a battery) is connected to the terminal bolt 30*a*. Another lead wire 32 is connected to the terminal bolt 30*b* by means of a nut 33 so that the lead wire 32 can be extended to a brush unit. A movable contact 34 is held behind the stationary contacts 30 through a pair of insulating members 35*a* and 35*b*. A coil spring 36 is disposed between the movable core 26 and the insulating member 35*a*, where the coil spring 36 gives a contact pressure to the movable contact 34. A cover member 37 made from magnetic material is installed to the rear end of the magnetic path case 25.

FIG. 2 illustrates a sectional view of main components of a conventional coaxial-type starter denoting the second conventional art disclosed in the Japanese Patent Application Laid-Open No. 1-92573 of 1989 for example. Those reference numerals 1 through 11 and 13 through 17 shown in FIG. 2 respectively designate component members identical to those which are shown in FIG. 1.

The reference numeral 12 designates a bearing unit which is made available for holding the front end of the hollow armature rotating shaft 7. The reference numeral 20 designates an electromagnetic switch apparatus which is coaxially coupled with the rear end of the DC motor 1. The electromagnetic switch apparatus 20 has the structure shown below. An exciting coil 21 is wound on a bobbin 22. A stationary core 23 is provided in front of the exciting coil 21, whereas a rear core 18 is provided behind the exciting coil 21. A magnetic path case 25 made from magnetic material is coupled with the rear bracket 4 with surrounding the rear end and external circumference of the exciting coil 21. The magnetic path case 25 firmly secures the stationary core 23 and the rear core 18, where the magnetic path case 25 and the rear core 18 conjunctionally make up a magnetic path core. A guide bush member 24 which is made from non-magnetic material and secured to the stationary core 23 is inserted in the internal circumference of the bobbin 22. A movable core 26 is held inside of the guide bush member 24 with facing to the stationary core 23 so that the movable core 26 can slidably move itself in the axial direction. The movable core 26 makes up a plunger.

A pair of stationary contacts 30 are secured to the rear bracket 4 through an insulating member 31. A terminal bolt 30*a* extends from one of the stationary contacts 30. A lead wire (not shown) extended from a DC power-supply source (a battery) is connected to the terminal bolt 30*a*. A hollow rod 19 made from non-magnetic material is secured to the movable core 26. A movable contact 34 directly facing to these stationary contacts 30 is held by the hollow rod 19 with an insulating member 35 intervened. The hollow rod 19 is brought back to the original position by a return spring 39. The movable contact 34 is given a contact pressure by a compression spring 38. The rear end of a push rod 27 is held in the hollow rod 19 so that the push rod 27 can move itself in the axial direction. This push rod 27 is energized by a coil spring 28 and carried forward by the forward movement of the movable core 26, and then, the push rod 27 pushes the output rotary shaft 15 forward through a steel ball 29. Then, the steel ball 29 is energized by another coil spring 40 until it arrives at the innermost region of the rear end of the output rotary shaft 15. A spring shoe 41 is secured to the inner rear end of the hollow rod 19. A cover member 37 is coupled with the magnetic path case 25. Furthermore, the magnetic path case 25, the rear bracket 4, and the relay iron member 2, are engaged with the front bracket 13 by means of a through bolt 42.

Next, functional operations of the starter featuring the above structure are described below.

As soon as the starting switch of the engine is activated, DC power flows through the exciting coil 21, and then, the movable core 26 is attracted to the stationary core 23. As a result, the push rod 27 moves itself forward in order to push the output rotary shaft 15 in the forward direction, thus causing the pinion 17 to be engaged with the ring gear of the engine. Simultaneously, the movable contact 34 comes into contact with a pair of stationary contacts 30. As a result, a circuit connected to the armature coil 9 closes itself so that DC power can flow through it to activate rotation of the armature 6. Next, rotation of the armature rotary shaft 7 is reduced by the epicyclic gear unit, and then, the decelerated rotating force is transmitted from the output rotary shaft 15 to the pinion 17 through the overrunning clutch before eventually activating the rotation of the engine itself.

After turning the engine ON, the starting switch is turned OFF by the driver. Then, DC power supply to the exciting coil 21 is shut off, and then, the output rotary shaft 15 is brought back to the original position by effect of the return spring (not shown), thus disengaging the pinion 17 from the ring gear of the engine. Simultaneously, the movable core 26 is also brought back to the original position before the movable contact 26 eventually leaves a pair of those stationary contacts 30.

The above-cited conventional starter denoting the first conventional art provides a pair of stationary contacts 30 and the movable contact 34 at the rear end side of the magnetic path core, and as a result, a pair of those terminal bolts 30*a* and 30*b* projecting themselves in the radial direction from the external circumferential surfaces must compulsorily be disposed at the rear end side of the electromagnetic switch apparatus 20. Depending on the structure of the engine, positions of these terminal bolts 30*a* and 30*b* disturb subsequent operation to install the starter to the engine, and therefore yet, distribution of lead wire from the DC power supply source involves obstacle.

Furthermore, the rear end of the hollow rod 19 of the other conventional structure denoting the second conventional art is held by the guide bush member 24 of the movable core 26, and in addition, the intermediate region of the hollow rod 19 is held inside of the internal circumference of an insulating member 31 across a substantial gap. The insulating member 31 is held by the rear bracket 4. Since concentricity is variable by execution of assembly work, the substantial gap must be provided for the hollow rod 19. On the other hand, because of this substantial gap, the hollow rod 19 may incline itself, thus coming into contact with the internal circumferential surface of the hollow armature rotating shaft 7. This in turn causes the hollow rod 19 to also rotate with the shaft 7. Likewise, the movable contact 34 also starts to rotate itself, and as a result, the movable contact 34 cannot stably come into contact with the stationary contacts 30. Furthermore, metallic powder generated by the friction between the hollow rod 19 and the internal surface of the hollow armature rotating shaft 7 can easily enter into the contact chamber through the substantial gap between the insulating member 31 and the hollow rod 19. As a result, the abraded metallic powder easily adheres to the sliding surface of the contact chamber against the movable core 26, thus eventually obstructing the sliding movement between the surface of the contact chamber and the movable iron core 26 to lower the insulating effect against those contacts. Furthermore, grease of the bearing unit 11 may infiltrate into the contact chamber to obstruct proper contact between the movable contact 34 and the stationary contacts 30.

SUMMARY OF THE INVENTION

An object of the invention is to provide a novel electromagnetic switch apparatus which can easily be installed to an engine and a novel starter capable of effectively using this electromagnetic switch apparatus.

Another object of the invention is to provide a novel electromagnetic switch apparatus having external length shorter than that of any conventional electromagnetic switch apparatus and a novel starter capable of effectively using this electromagnetic switch apparatus.

Another object of the invention is to provide a novel electromagnetic switch apparatus which allows a magnetic path core to easily hold a pair of stationary contacts electrically insulated therefrom and a novel starter capable of effectively using this electromagnetic switch apparatus.

A still further object of the invention is to provide a novel starter which can constantly hold a hollow rod and an armature rotating shaft in perfect concentricity and fully prevent abraded metallic powder from occurrence.

A still further object of the invention is to provide a novel starter which can prevent all the contacts from improperly coming into contact with and incompletely being insulated from each other, and yet, prevent the movable core from improperly sliding itself.

The electromagnetic switch apparatus embodied by the invention characteristically provides both the stationary and movable contacts behind the magnetic path core, where each of the stationary contacts has a contact part and a conductive part which are integrally formed in L-shape. The conductive part in the axial-directional side extend to the external circumference of an exciting coil, where a terminal bolt is connected to the end of the conductive part and extends in the radial direction. This conductive part extends farther from the external periphery of the exciting coil until reaching the front end of the stationary core.

A pair of the stationary contacts are respectively molded in insulating member which is secured to the rear end of the magnetic path core. Each of these stationary cores may also be molded inside of an individual insulating member, or both of these stationary contacts may conjunctionally be molded in an identical insulating member. In addition, an O-ring is secured to the external circumference of insulating member, where the O-ring is sandwiched by a case and a cover member surrounding the exciting coil in the axial direction, thus achieving water-proof sealing effect.

The intermediate region of a hollow rod (where the hollow rod is secured to the movable core, and yet, the front end of this hollow rod extends to a hollow space of an armature rotating shaft) is held by the internal circumferential surface of the stationary core across extremely narrow gap just enough to allow the hollow rod to slidably move itself in the axial direction.

The above and further objects and features of the invention will more fully be apparent from the following detailed description with accompanying drawings.

DESCRIPTION OF THE PREFERRED EMBODIMENTS

Referring now to the accompanying drawings, the electromagnetic switch apparatus and the starter embodied by the invention are described below.

The First Embodiment

Figure 1:
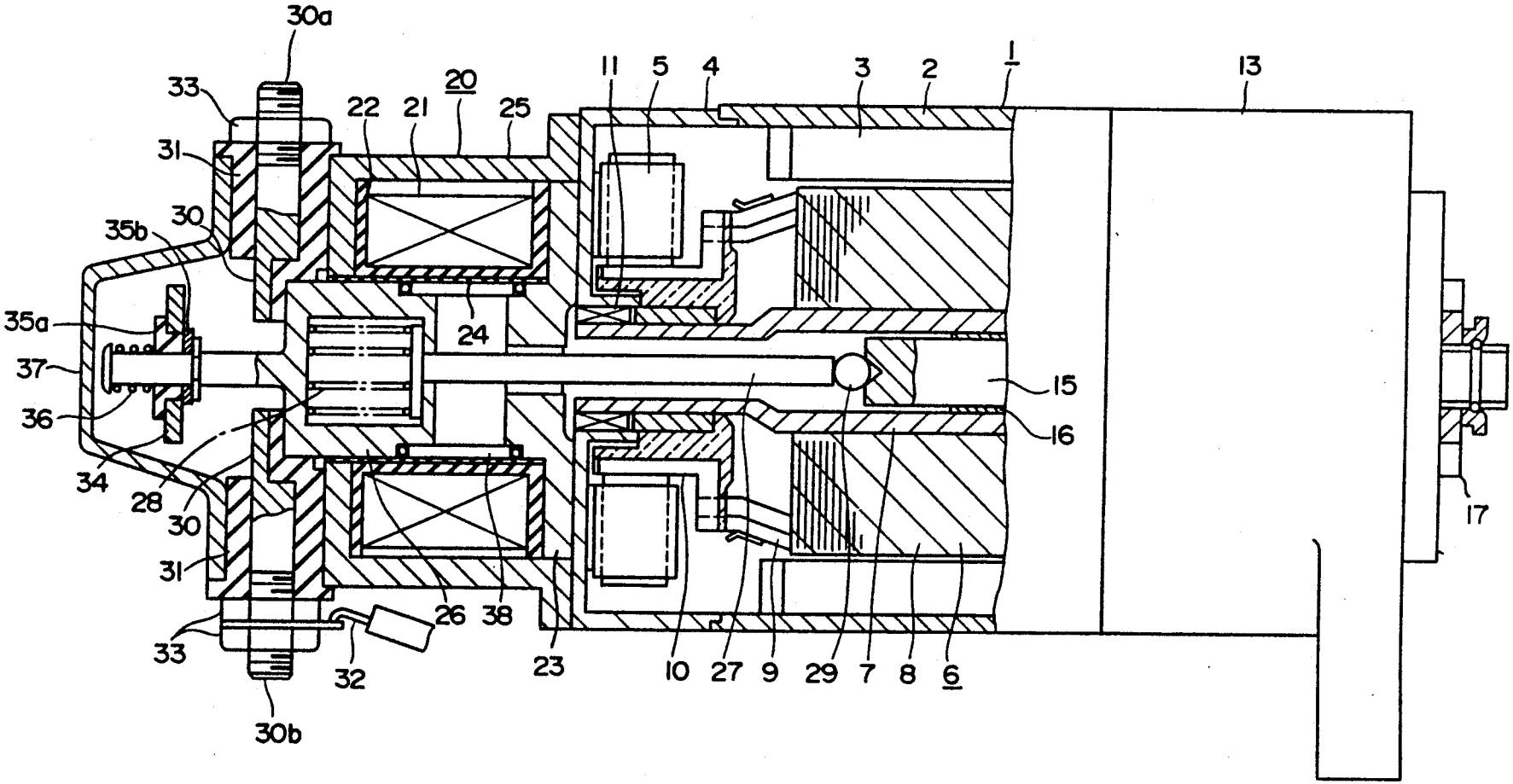
Fig. 1 Prior Art
FIG. 1 is a vertical sectional view of a conventional starter.
Figure 2:
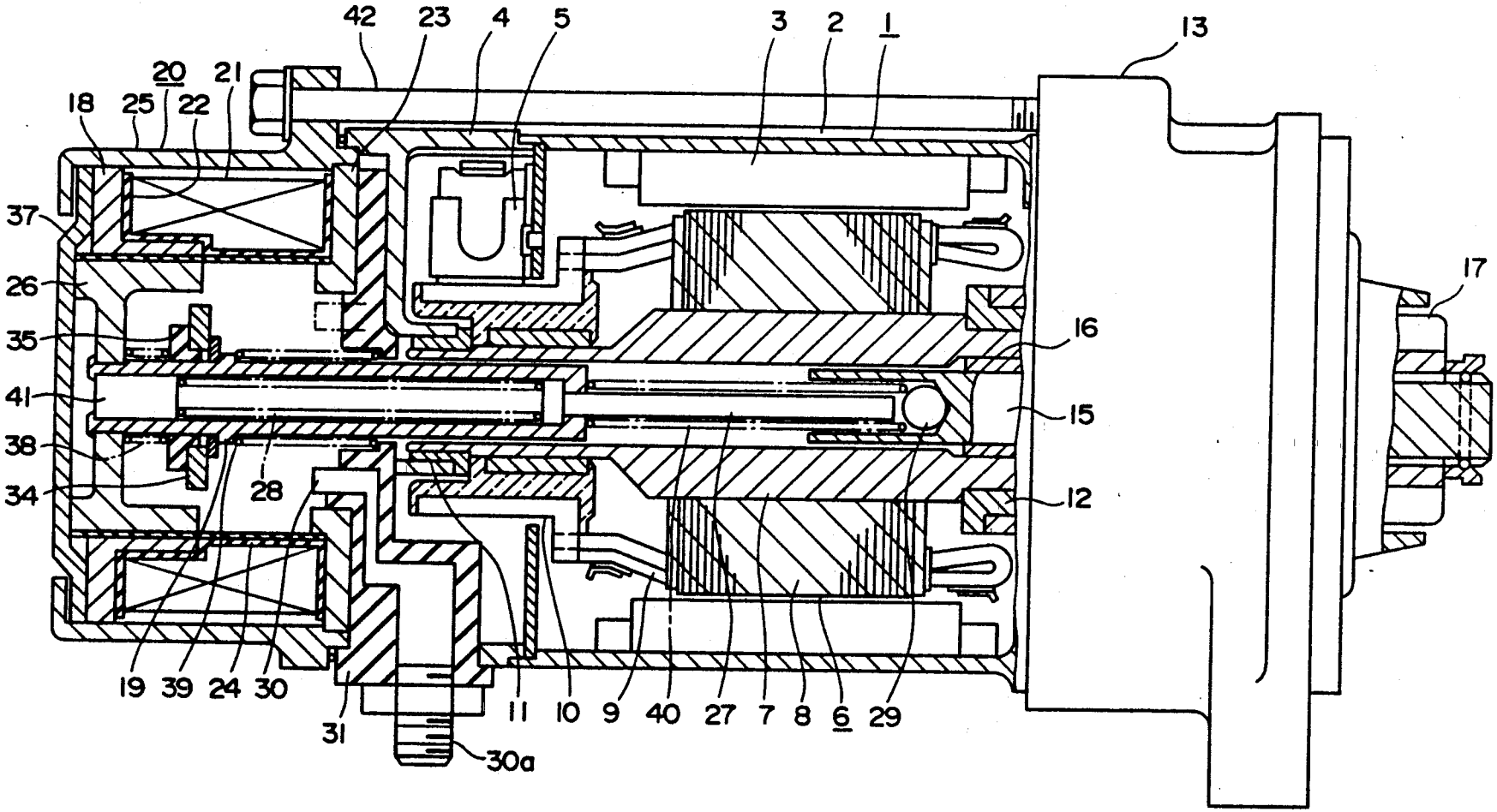
Fig. 2 Prior Art
FIG. 2 is a vertical sectional view of another conventional starter.
Figure 3:
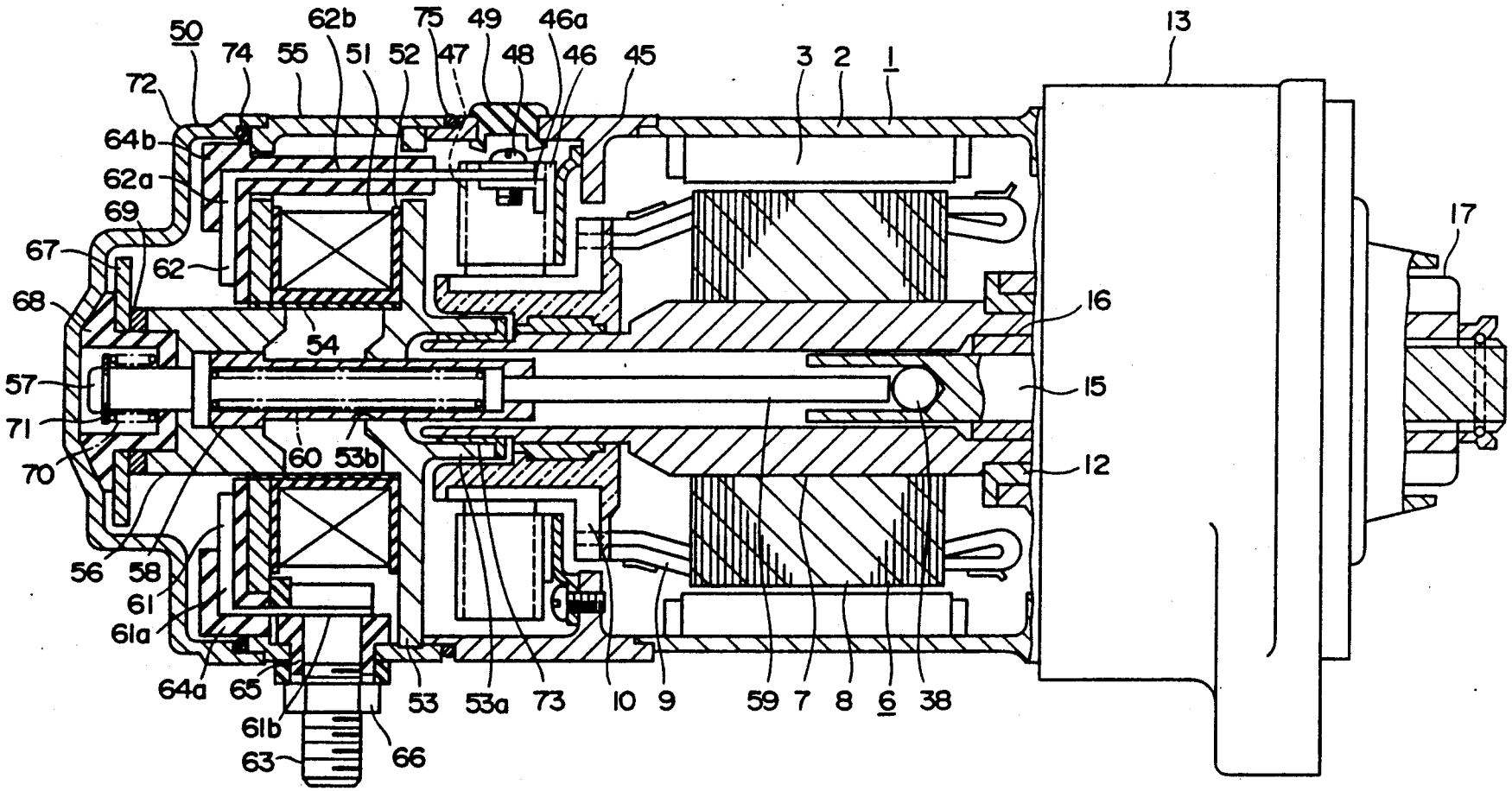
FIG. 3 is a vertical sectional view of the first embodiment of the invention.

FIG. 3 is a vertical sectional view of the coaxial type starter applying the electromagnetic switch apparatus according to the first embodiment of the invention. The reference numeral 1 shown in FIG. 3 designates a DC motor, which incorporates a relay iron member 2 which secures a field pole 3 (a permanent magnet) thereto. The reference numeral 45 designates a rear bracket which secures a brush holder 46 thereto. The brush holder 46 holds a brush box by way of insulation, and a brush 47 is inserted in the brush holder 46.

The referene numeral 6 designates an armature which comprises the following; a hollow armature rotating shaft 7, an armature core 8 which is secured to the hollow armature rotating shaft 7, an armature coil 9 which is wound on the armature core 8, and a commutator 10 which is secured to the hollow armature rotating shaft 7 and connected to the armature core 8, respectively. The rear end of the hollow armature rotating shaft 7 is held by the rear bracket 45, whereas the front end thereof is held by a bearing holder integrated with the front end itself through a bearing unit 12. A front bracket 13 is coupled with the relay iron member 2. The front bracket 13 incorporates an epicyclic reduction gear unit which is engaged with a pinion 17 (a sun gear) provided on the external circumference of the front end of the hollow armature rotating shaft 7 and an overrunning clutch which is engaged with the output unit of the epicyclic reduction gear unit, respectively. The rear end of an output rotary shaft 15 is held by the hollow armature rotating shaft 7 through a sleeve bearing unit 16. The intermediate region of the hollow armature rotating shaft 7 is coupled with the overrunning clutch by a helical spline. The rotating force of the hollow armature rotating shaft 7 is transmitted to the output rotary shaft 15, and as a result, the pinion 17 engaged with the front end of the output rotary shaft 15 by a spline is rotated. The pinion 17 is carried forward by the forward movement of the output rotary shaft 15, and then, the pinion 17 is engaged with a ring gear (not shown) of the engine so that the engine can start up own rotation.

The reference numeral 50 designates an electromagnetic switch apparatus which is coaxially coupled with the rear end of the DC motor 1, where the electromagnetic switch apparatus 50 has those structural features described below.

An exciting coil 51 is wound on a bobbin 52, whereas a stationary core 53 is held in contact with the front end of the bobbin 52. The stationary core 53 partitions the internal regions of the DC motor 1 off from the electromagnetic switch apparatus 50. A bearing unit 73 like a sleeve bearing is secured to the internal surface of a projection 53*a* on the part of the internal circumferences of the stationary core 53 in order to hold the rear end of the hollow armature rotating shaft 7. A guide bush member 54 made from non-magnetic material secured to the stationary core 53 is inserted in the internal circumference of the bobbin 52. A magnetic path case 55 made from magnetic material is coupled with the rear bracket 45 with surrounding the rear end and external circumference of the exciting coil 51. The stationary iron core 53 is secured to the front end of the magnetic path case 55 which makes up a magnetic path core itself. A movable core 56 is held in the guide bush member 54 with facing to the stationary iron core 53 so that the movable core 56 can slidably move itself in the axial direction. The movable core 56 makes up a plunger. A supporting rod 57 projecting itself backward is firmly inserted in the movable core 56. A hollow rod 58 made from magnetic material projects itself in the forward direction until reaching hollow space of the armature rotating shaft 7. The hollow rod 58 is secured to the movable core 56. The intermediate region of the hollow rod 58 is held by the internal circumferential portion 53*b* of the stationary core 53 across a minimal gap needed for allowing the hollow rod 58 to slidably move itself in the axial direction. The push rod 59 is held in the hollow rod 58 so that the push rod 59 can move itself in the axial direction. The push rod 59 is energized by a coil spring 60, and the front end of the push rod 59 presses the rear end of the output rotary shaft 15 through a steel ball 38.

A pair of stationary contacts 61 and 62 are respectively provided for the rear end of the magnetic path case 55. These stationary contacts 61 and 62 are respectively composed of radial-directional contact parts 61*a* and 62*a* and radial-directional conductive parts 61*b* and 62*b* aligned in L-shape, where these conductive parts 61*b* and 62*b* are disposed along the external periphery of the exciting coil 51. These stationary contacts 61 and 62 are respectively molded in plastic insulating members 64*a* and 64*b* which are secured to the rear end of the magnetic path case 55. A terminal bolt 63 penetrating the conductive part 61*b* of the stationary contact 61 projects in the radial direction, where the terminal bolt 63 penetrates the magnetic path case 55 through an insulating member 65. The terminal bolt 63 is fastened with a nut 66. A lead wire (not shown) extended from a DC power-supply source (a battery) is connected to the terminal bolt 63. An end of the conductive part 62*b* of the stationary contact 62 is held in contact with a receptive member 46*a* of the brush holder 46, where the lead wire of the bruch 47 is connected to the receptive member 46*a* by a fastening screw 48. A rubber cap 49 is inserted in a hole of the rear bracket 45.

A movable contact 67 opposite from the external surfaces of the stationary contacts 61 and 62 is held by an insulative holder 68 which is respectively held by the supporting rod 57 to allow the movable contact 67 to move itself in the axial direction. An insulating plate 69 is inserted between the movable contact 67 and the movable core 56. A compression spring 70 is inserted between a stopper ring 71 coupled with the supporting rod 57 and the insulative holder 68 so that the movable contact 67 can respectively be energized. A cover member 72 made from non-magnetic material is secured to the magnetic path case 55. An O-ring 74 is inserted between the cover member 72 and the magnetic path case 55. Another O-ring 75 is inserted between the magnetic path case 55 and the rear bracket 45.

The Second Embodiment

Figure 4:
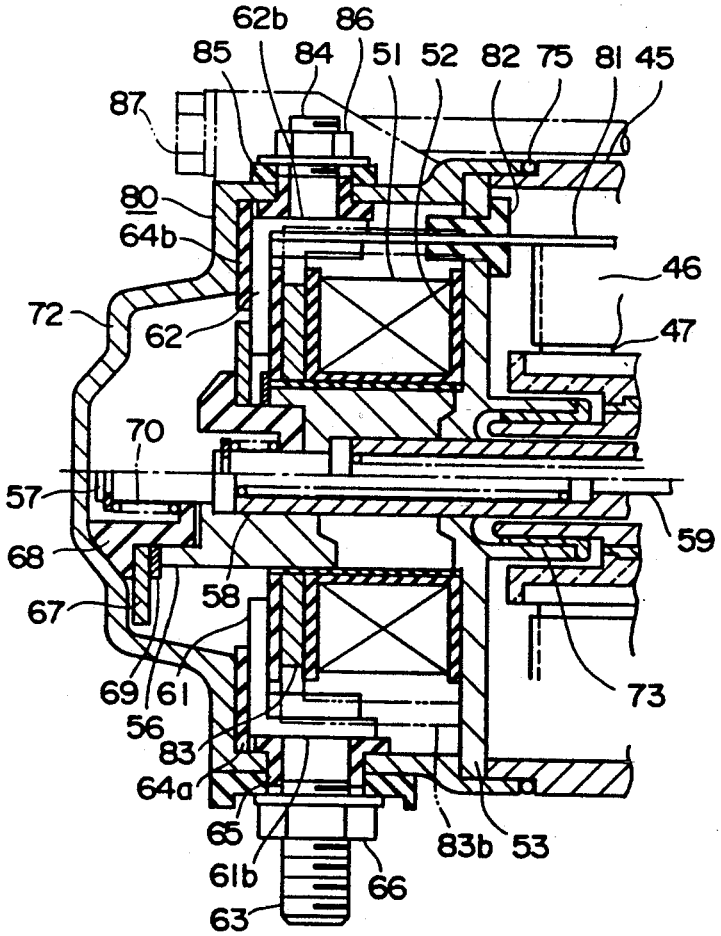
FIG. 4 is a vertical sectional view of the second embodiment of the invention.

FIG. 4 is a vertical sectional view of the electro-magnetic switch apparatus according to the second embodiment of the invention. Those components with the reference numerals identical to those which are shown in FIG. 3 respectively designate the identical components introduced to the second embodiment. The upper half of the electro-magnetic switch apparatus shown in FIG. 4 designates a state in which the movable core 56 has moved forward by effect of attractive force, whereas the lower half designates a state in which the movable core 56 has been brought back to the original position. Like the first embodiment, the electromagnetic switch apparatus 80 is coaxially coupled with the DC motor 1. The terminal bolt 63 connected to a lead wire extended from the DC power-supply source is connected to the end of the conductive part 61*b* making up the axial-directional side of one L-shaped stationary contact 61. The terminal bolt 63 projects in the radial direction through the insulating member 65 at the rear side of the exciting coil 51. The conductive part 62*b* making up the axial-directional side of the other L-shaped stationary contact 62 is connected to a conductive member 81 by means of a bolt 84 fastened through an insulating member by a nut 86. The conductive member 81 extends outside of the external circumference of the exciting coil 51 in the axial direction and penetrates the stationary core 53 through an insulating brush member 82. A lead wire of the brush 47 is connected to the conductive member 81. The front end of a cylindrical member 83*b* of a magnetic path core 83 is coupled with the rear end of the stationary core 53. A notch is provided for the cylindrical member 83*b* corresponding to the terminal bolt 63 and the conductive member 81. The cover member 72, the rear bracket 45, and the relay iron member, are respectively secured to the front bracket by a bolt 47.

The Third Embodiment

Figure 5:
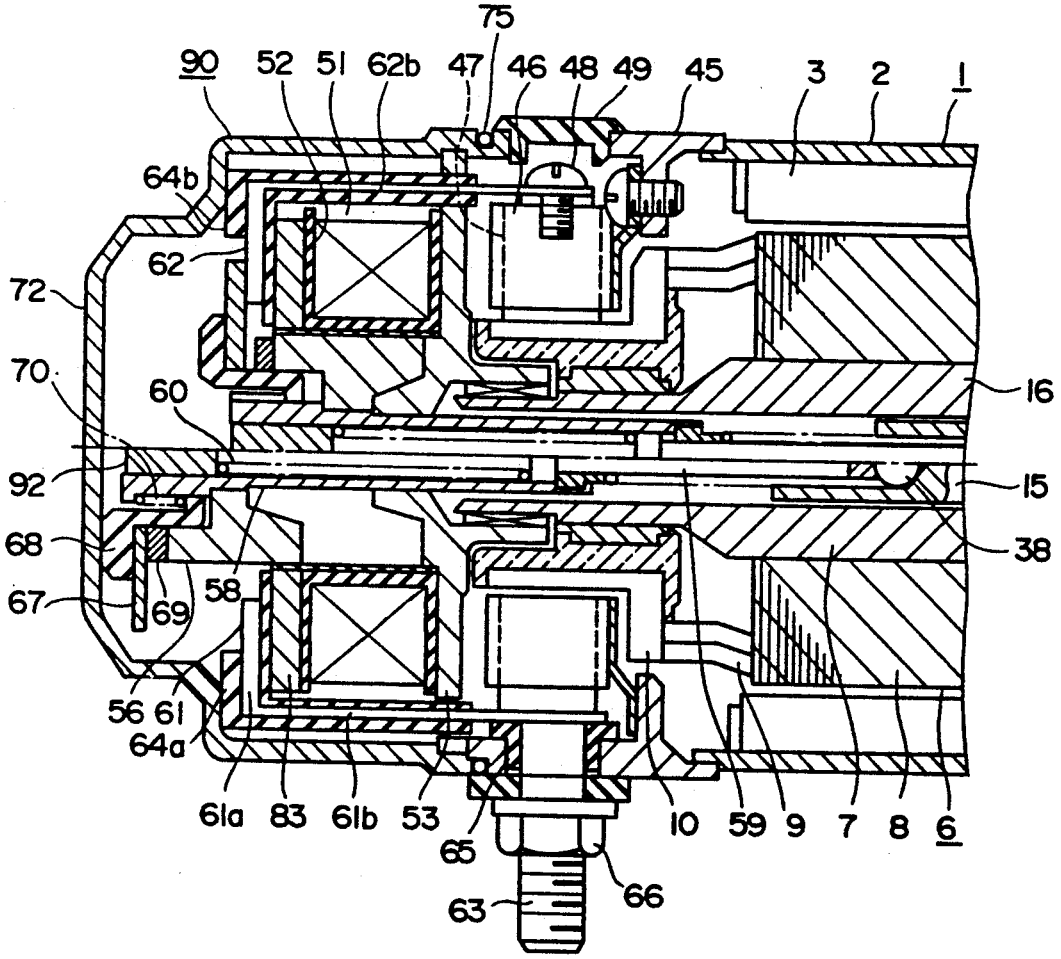
FIG. 5 is a vertical sectional view of the third embodiment of the invention.

FIG. 5 is a vertical sectional view of the electromagnetic switch apparatus according to the third embodiment of the invention. Those components with the reference numerals identical to those which are shown in FIGS. 3 and 4 respectively designate identical components introduced to the third embodiment. The upper half of the electromagnetic switch apparatus shown in FIG. 5 designates a state in which the movable core 56 has moved forward by effect of attractive force, whereas the lower half designates a state in which the movable core 56 has been brought back to the original position. According to the third embodiment, the position of the terminal bolt 63 is in front of the stationary 53, in other words, the terminal bolt 63 is set to the rear bracket 45. Like the first embodiment, the electromagnetic switch apparatus 90 is coaxially coupled with the DC motor 1. The conductive part 61*b* of the lower L-shaped stationary contact 61 penetrates the stationary core 53 and then extends to the rear bracket 45. The conductive part 61*b* is connected to the terminal bolt 63 at a position between the brushes 47. The terminal bolt 63 penetrates the rear bracket 45 in the radial direction through the insulating member 65 and then projects externally. The conductive part 62*b* of the upper L-shaped stationary contact 62 penetrates the stationary core 53, where the conductive part 62*b* is connected to the lead wire of the brush 47 by the fastening screw 48. The hollow rod 58 firmly inserted in the movable core 56 supports the insulative holder 68 so that the insulative holder 68 can move itself in the axial direction. The compression spring 70 gives a contact pressure to the movable contact 67. A spring receptive member 92 is provided at the rear end of the hollow rod 58 in order to accommodate the coil spring 60.

Figure 6:
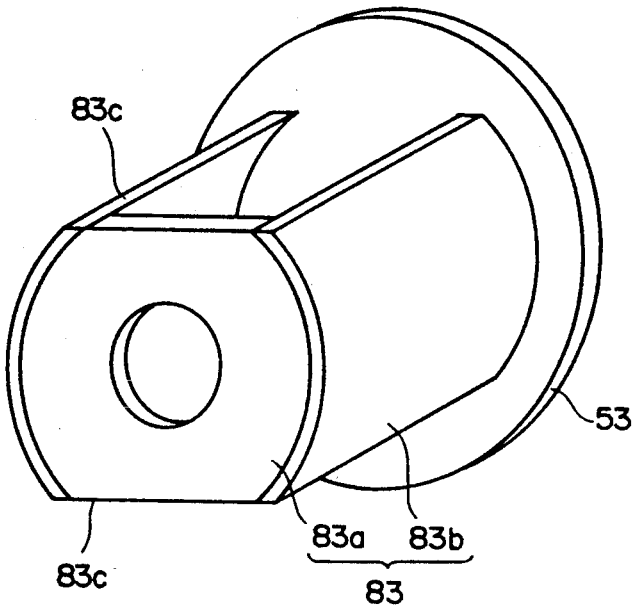
FIG. 6 is a perspective view denoting the structure of the magnetic path core embodied by the invention.
Figure 7:
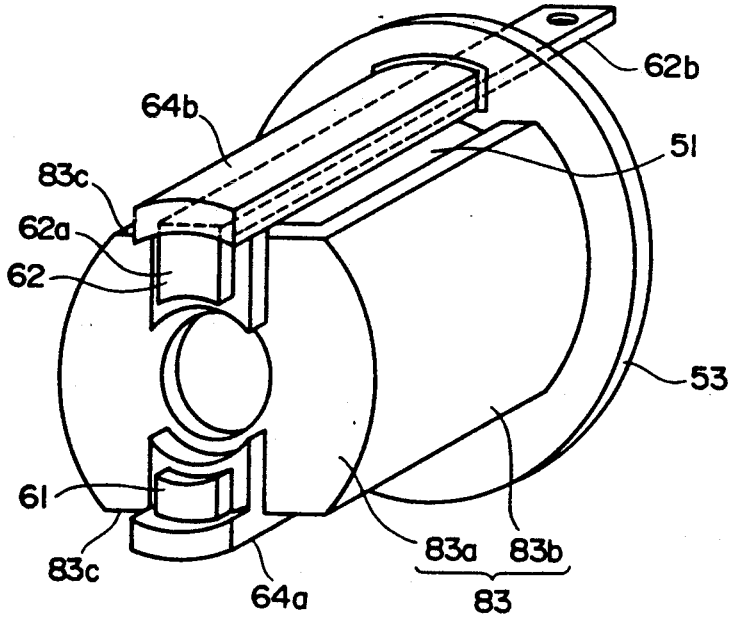
FIG. 7 is a perspective view denoting the position relationship between the magnetic path core and the stationary contacts embodied by the invention.

FIG. 6 is a perspective view of the magnetic path core 83 built in the electromagnetic switch apparatus of the third embodiment. FIG. 7 is a perspective view designating the relationship between the magnetic path core 83 and those stationary contacts 61 and 62. The magnetic path core 83 is composed of a vertically disposed disc plate 83*a* set to the rear end of the exciting coil 51 and a cylindrical member 83*b*. A plurality of projections are set to the front end of the cylindrical member 83*b*. These projections respectively pass a plurality of holes of the stationary core 53, where these projections and holes are caulked with each other. Alternatively, these projections and holes can be coupled with each other with a bolt. A pair of notches 83*c* are provided on the external circumferential surface of the cylindrical member 83*b*. The conductive part 61*b* of the stationary contact 61 and the conductive part 62*b* of the other stationary contact 62 are respectively molded in the insulating members 64*a* and 64*b*. Those conductive parts 61*b* and 62*b* are respectively installed in those notches 83*c* and project forward with horizontally penetrating the stationary core 53.

Figure 8:
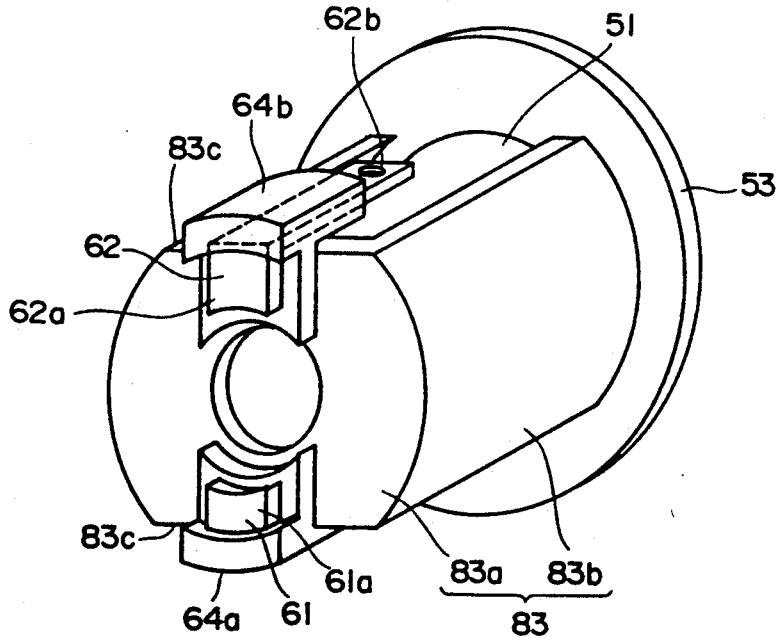
FIG. 8 is a perspective view denoting another position relationship between the magnetic path core and the stationary contacts embodied by the invention.

FIG. 8 designates the relationship between the magnetic path core 83 and the stationary contacts 61 and 62 of the first and second embodiments, in which the end of the conductive part 61*b* of the stationary contact 61 and the end of the conductive part 62*b* of the stationary contact 62 are respectively set to the external circumference of the exciting coil 51, the terminal bolt 63 projecting in the radial direction.

When executing the first through third embodiments thus far described, the conductive part 61*b* making up the axialdirectional side of the L-shaped stationary contact 61 is set to the external circumference of the exciting coil 51 or the rear of the magnetic path core 83 beyond the external circumference of the exciting coil 51, and yet, the terminal bolt 63 connected to the end of this conductive part 61*b* projects in the radial direction. By virtue of this mechanical structure, the electromagnetic switch apparatus embodied by the invention can easily be installed to the engine.

The internal circumference of the projection 53*a* and the internal circumferential portion 53*b* of the stationary iron core 53 can simultaneously be processed by mechanical means in order that both can be provided with precise concentricity. As a result, precise concentricity can constantly be held between the hollow rod 58 held in the internal circumferential portion 53*b* across a minimal gap and the hollow region of the armature rotating shaft 7 held by the bearing unit 73 secured to the inner surface of the projection 53*a*. In consequence, the front end of the hollow rod 58 remains apart from those inner components, and thus, metallic powder cited earlier can be prevented from occurrence otherwise generated by abrasion between the hollow rod 58 and those adjoining internal components. Furthermore, owing to the provision of extremely minimal gap, grease of the bearing unit 73 can be prevented from flowing into the movable core 56, thus ensuring satisfactory contact between the movable contact 67 and those stationary contacts 61 and 62.

The Fourth Embodiment

Figure 9:
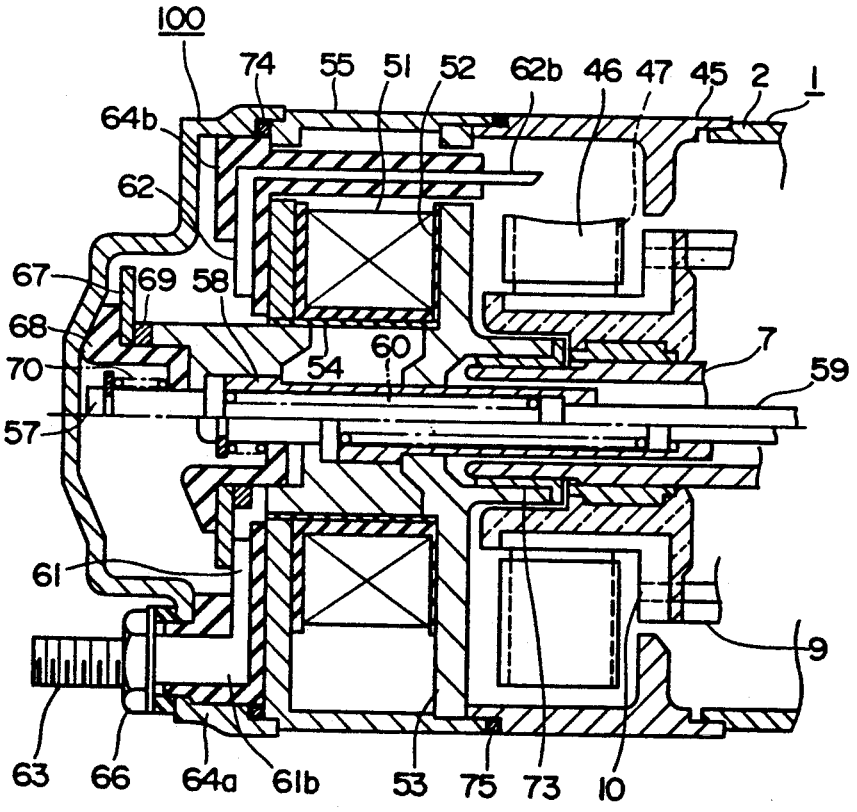
FIG. 9 is a vertical sectional view of the fourth embodiment of the invention.

FIG. 9 is a vertical sectional view of the electromagnetic switch apparatus according to the fourth embodiment of the invention. Those components with the reference numerals identical to those which are shown in FIGS. 3 through 5 respectively designate identical components introduced to the fourth embodiment of the invention. The lower half of the electromagnetic switch apparatus shown in FIG. 9 designates a state in which the movable core 56 has moved forward by effect of attractive force, whereas the upper half designates a state in which the movable core 56 has been brought back to the original position. According to the fourth embodiment, the terminal bolt 63 projects in the axial direction. Like the first embodiment, the electromagnetic switch apparatus 100 is coaxially coupled with the DC motor 1. The conductive part 61*b* of the lower L-shaped stationary contact 61 is built in the rear end of the magnetic path case 55 which itself makes up the magnetic path core of the electromagnetic switch apparatus 100. The conductive part 61*b* projects backward in the axial direction in conjunction with the terminal bolt 63 which also projects in the axial direction. Lead wire extended from the DC power-supply source is connected to the terminal bolt 63. In the event that the posture of the terminal bolt 63 projecting in the radial direction of the electromagnetic switch apparatus disturbs smooth installation of this apparatus to the engine, then, the structure according to the fourth embodiment is quite useful to avoid the assembly inconvenience.

The Fifth Embodiment

Figure 10:
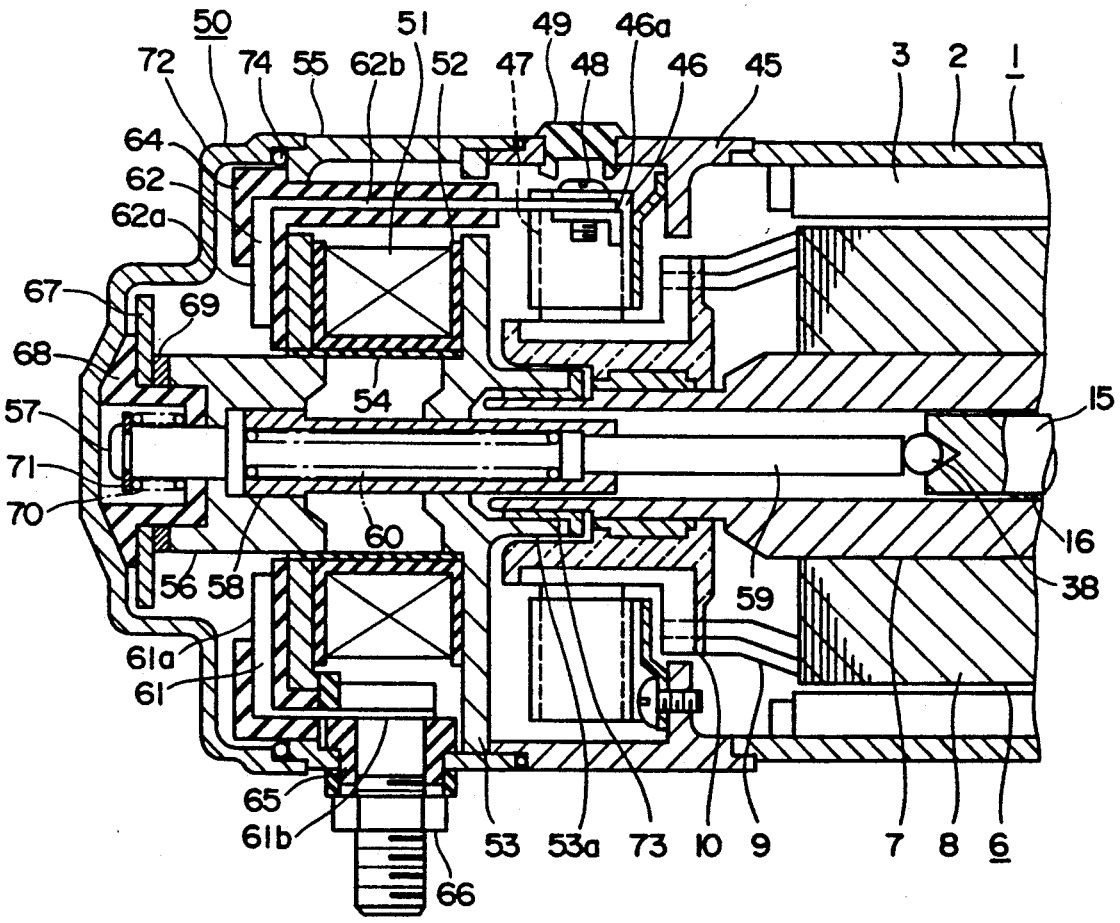
FIG. 10 is a vertical sectional view of the fifth embodiment of the invention.
Figure 11:
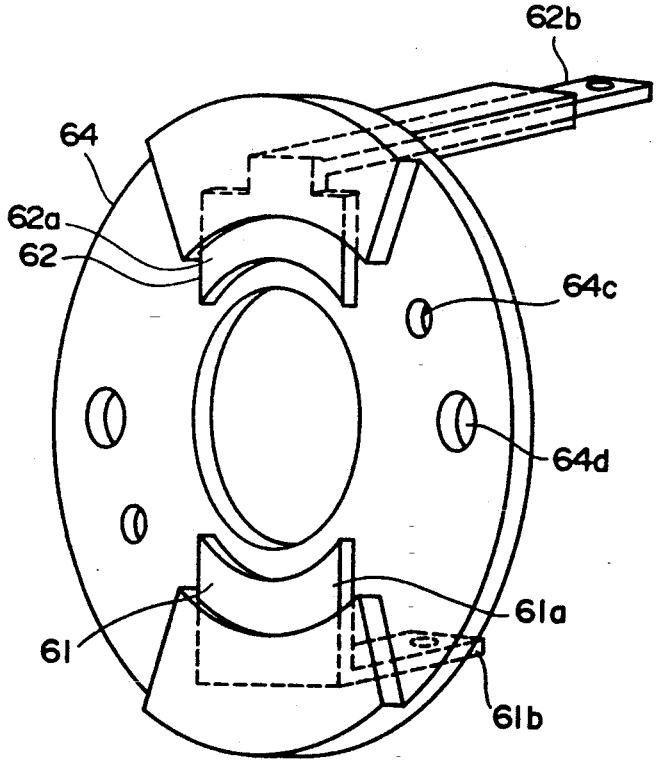
FIG. 11 is a perspective view of the insulating member in which the stationary contacts are molded in the fifth embodiment.

FIG. 10 is a vertical sectional view of the electromagnetic switch apparatus according to the fifth embodiment of the invention. Those components with the reference numerals identical to those which are shown in FIG. 3 respectively designate identical components introduced to the fifth embodiment. According to the first through fourth embodiments thus far described, those stationary contacts 61 and 62 are molded respectively in the insulating members 64*a* and 64*b*. However, according to the fifth embodiment, both of these stationary contacts 61 and 62 are conjunctionally molded in one insulating member 64. FIG. 11 is a perspective view denoting the periphery of these components. The insulating member 64 is of hollow disc shape, through which a hole 64*c* allowing passage of lead wire of the exciting coil 51 and another hole 64*d* allowing passage of a bolt are respectively provided. The insulating member 64 is secured to the rear end of the magnetic path case 55 by the bolt inserted in the hole 64*d*. The conductive part 61*b* of the lower stationary contact 61 in the insulating member 64 extends in the axial direction, where the terminal bolt 63 is connected to the extended end of the conductive part 61*b*. The conductive 62*b* of the upper stationary contact 62 further extends in the axial direction up to the position of the brush holder 46. The lead wire of the brush 47 is connected to the farthest end of the conductive part 62*b* by the fastening screw 48.

Figure 12A:
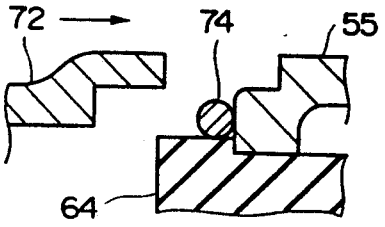
FIG. 12(*a*) is a sectional view of the unassembled O-ring and FIG. 12(*b*) is a sectional view of the assembled O-ring.
Figure 12B:
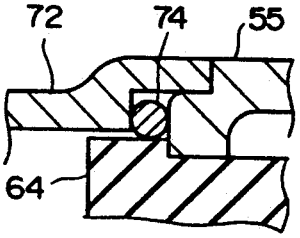

Taking the fifth embodiment for example, the method of applying the O-ring 74 to the cover member 72 is described below. FIGS. 12(*a*) and 12(*b*) respectively illustrate the way of securing the cover member 72 to the magnetic path case 55. As shown in FIG. 12(*a*), the O-ring 74 is set to the external circumference of the insulating member 64 with coming into contact with the rear end of the magnetic path case 55. Next, as shown in FIG. 12(*b*), the projecting coupling member at the front end of the cover member 72 is united with the coupling recess at the rear end of the magnetic path case 55. Due to compressed effect applied to the O-ring 74, waterproof effect is generated. In this way, availing of the external circumference of the insulating member 64 as a guiding means, the O-ring 74 is compressed by the cover member 72 and the magnetic path case 55, and yet, the O-ring 74 can easily be assembled into the system.

Next, functional operation of the electromagnetic switch apparatus in conjunction with the starter as per those first through fith embodiments is described below. The electromagnetic switch apparatus executes identical operations in all those embodiments thus far described.

First, when DC power is supplied to the exciting coil 51, the movable core 56 is attracted to the stationary core 53. As a result, the push rod 59 is pushed forward by the coil spring 60. This causes the output rotary shaft 15 to move forward before engaging the pinion 17 (shown in FIG. 3) with the ring gear of the engine. At the same time, the movable contact 67 comes into contact with those stationary contacts 61 and 62 to cause DC power to flow through the armature coil 9 so that the armature 6 can be rotated. Then, the armature rotating shaft 7 rotates itself to cause the pinion 17 to also rotate itself, thus starting up the rotation of the engine. When the DC power supply to the exciting coil 51 is shut off, the output rotary shaft 15 is brought back to the original position by the energized force of the return spring (not shown), and as a result, the movable core 56 is also brought back to the original position.

The above description has solely referred to those embodiments for applying the electromagnetic switch apparatus to a coaxial type starter. Nevertheless, the electromagnetic switch apparatus embodied by the invention is not only applicable to the coaxial type starter, but it is also effectively applicable to such a case in which the electromagnetic switch apparatus is disposed in parallel with a motor. In this case, terminal bolts externally project from conductive parts of respective stationary contacts.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A starter which starts up operation of an engine comprising;

a DC motor which incorporates a hollow armature rotating shaft;

an output rotary shaft whose one end is held inside of said hollow armature rotating shaft and the other end is provided with a pinion which is engageable with a ring gear of said engine by the movement thereof; and an electromagnetic switch apparatus including the following;

an exciting coil which is wound on a bobbin;

a first stationary core which covers an end of said exciting coil and holds an end portion of said armature rotating shaft through a bearing unit;

a second stationary core which envelops the other end and external circumference of said exciting coil and is coupled with said first stationary core;

a pair of stationary contacts which are respectively secured to said second stationary core with an insulating member intervened;

a movable core which is movably held at the internal circumference said of said bobbin with facing to said first stationary core and moves by excitation;

a movable contact which is electrically insulated from said movable core, is held thereby with facing to said pair of stationary contacts, and closes said pair of stationary contacts by the movement of said movable core;

a hollow rod which is secured to said movable core and extends into hollow region of said armature rotating shaft; and a push rod, which is held in said hollow rod, and of which one end is pressed against the end of said output rotary shaft through a steel ball; the intermediate region of said hollow rod being held in said first stationary core across a minimal gap narrowly allowing said hollow rod to slidably move therein.

2. An electromagnetic switch apparatus, comprising:

an exciting coil which is wound on a bobbin;

a first stationary core which covers one end of said exciting coil;

a second stationary core which covers the other end of said exciting coil and having a cylindrical portion which envelops an external circumference of said exciting coil, said second stationary core being coupled with said first stationary core, said cylindrical portion being provided with a pair of notches, said second stationary core further forming a case for housing said exciting coil;

a pair of stationary contacts respectively secured to said second stationary core with an insulating member disposed therebetween, said pair of stationary contacts being molded in said insulating member;

a movable core held from within an internal circumference of said bobbin facing said first stationary core and movable in an axial direction of said exciting coil toward said first stationary core upon excitation of said exciting coil;

a movable contact held by said movable core and facing said pair of stationary contacts, which contacts and closes said stationary contacts upon movement of said movable core;

a cover member coupled to said case which envelops said movable contact and said pair of stationary contacts; and a terminal member which supplies exciting current to said exciting coil;

wherein each of said stationary contacts is formed of a contact part in the radial direction of said exciting coil and a conductive part in the axial direction of said exciting coil, said conductive parts of said stationary contacts passing through said pair of notches and extending over the external circumferential position of said exciting coil, and said terminal member is connected to an end of a conductive part of a stationary contact, and projects in the radial direction of said exciting coil.

3. An electromagnetic switch apparatus as set forth in claim 2, further comprising:

an O-ring which is set in the junction between said case and said cover member and is secured to an external circumferential surface of said insulating member.

4. A starter for starting operation of an engine, comprising the electromagnetic switch apparatus of claim 2 and a D.C. motor coaxially coupled to said electromagnetic switch apparatus, so as to control the supply of power to said D.C. motor.

5. An electromagnetic switch apparatus as set forth in claim 2, wherein said apparatus has a pair of insulating members, and wherein each of said stationary contacts is molded in each of said pair of insulating members.

6. An electromagnetic switch apparatus as set forth in claim 2, wherein said insulating member is in the form of a hollow disc, and wherein each of said stationary contacts is molded in said insulating member.

* * * * *

UNITED STATES PATENT AND TRADEMARK OFFICE

CERTIFICATE OF CORRECTION

PATENT NO. : 5,227,751

DATED : July 13, 1993

INVENTOR(S) : Shiroyama et al.

It is certified that error appears in the above-identified patent and that said Letters Patent is hereby corrected as shown below:

On the title page:

In the Abstract; line 22, "accross" should be -- across --;

Col. 3, line 59, "yet" should be deleted;

Col. 6, line 42, "circumferences" should be -- circumference --.

Signed and Sealed this

Eighth Day of March, 1994

*Attest:*

Bruce Lehman

BRUCE LEHMAN

*Attesting Officer*

*Commissioner of Patents and Trademarks*